United States Patent [19]

DeMarco et al.

[11] Patent Number: 4,484,715

[45] Date of Patent: Nov. 27, 1984

[54] CORE PLUG

[75] Inventors: Richard E. DeMarco, Waldwick, N.J.; David Hopkins, Wilton; Dennis I. Deegan, Fairfield, both of Conn.

[73] Assignee: Westvaco Corporation, New York, N.Y.

[21] Appl. No.: 547,458

[22] Filed: Nov. 1, 1983

Related U.S. Application Data

[63] Continuation of Ser. No. 270,413, Jun. 4, 1981, abandoned.

[51] Int. Cl.[3] ..... B65D 85/67

[52] U.S. Cl. ..... 242/68.6

[58] Field of Search ..... 242/68.4, 68.5, 68.6

[56] References Cited

U.S. PATENT DOCUMENTS

| | | | |
|---|---|---|---|
| 1,008,924 | 11/1911 | Orr | 242/68.6 |
| 1,180,955 | 4/1916 | Stuck | 242/68.6 |
| 1,919,769 | 7/1933 | Brown | 242/68.6 |
| 2,196,378 | 4/1940 | Bebie | 242/68.6 |
| 3,840,194 | 10/1974 | Vetter | 242/68.6 |
| 3,865,326 | 2/1975 | Beaudoin | 242/68.6 |

OTHER PUBLICATIONS

Construction Methods, Jan. 1943, p. 60.

*Primary Examiner*—Stuart S. Levy
*Assistant Examiner*—Lloyd D. Doigan

[57] ABSTRACT

A solid core plug formed from wood, plastic, or a composite woody material of substantially cylindrical shape with a body portion and an integral tapered forward portion. The outer face of the body portion has a diameter substantially equal to the inside diameter of the core for which the core plug is intended, and the inner face of the forward portion is of slightly less diameter than the outer face to facilitate entry of the core plug into the ends of a core. The core plug includes an opening or groove spaced from the center thereof and near its remote outer edge which extends the full length thereof for facilitating removal of the core plug from a core.

4 Claims, 5 Drawing Figures

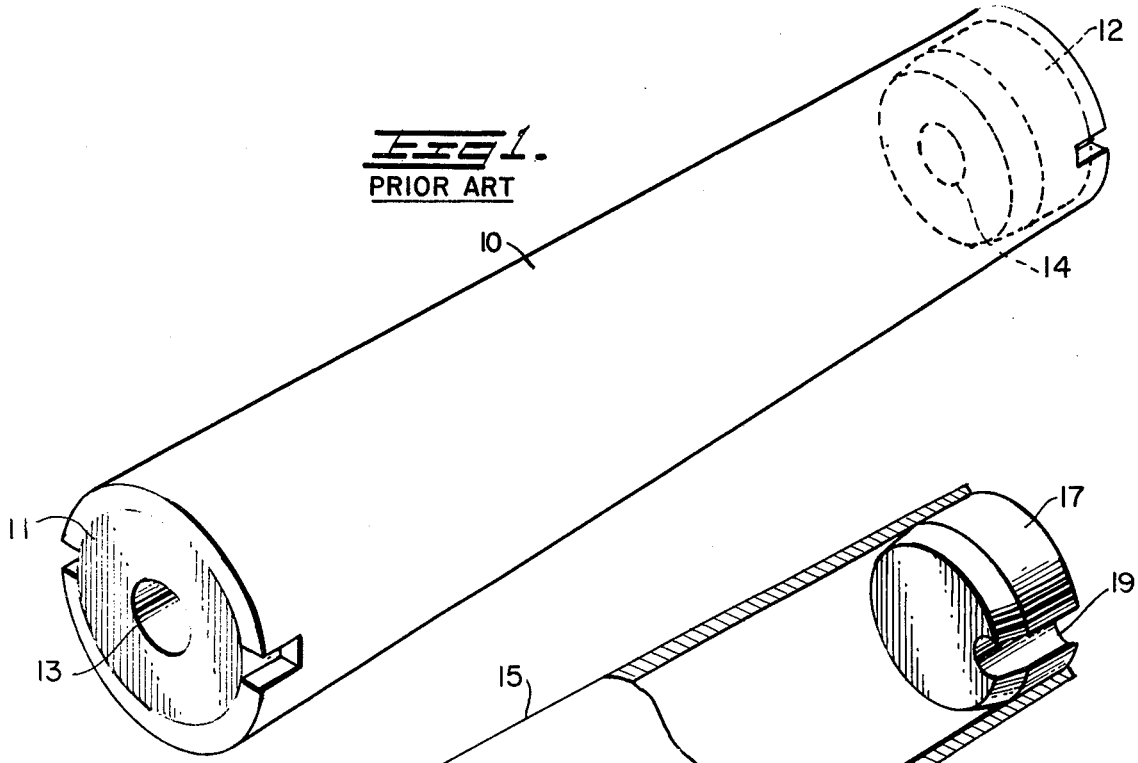
Fig 1.
PRIOR ART
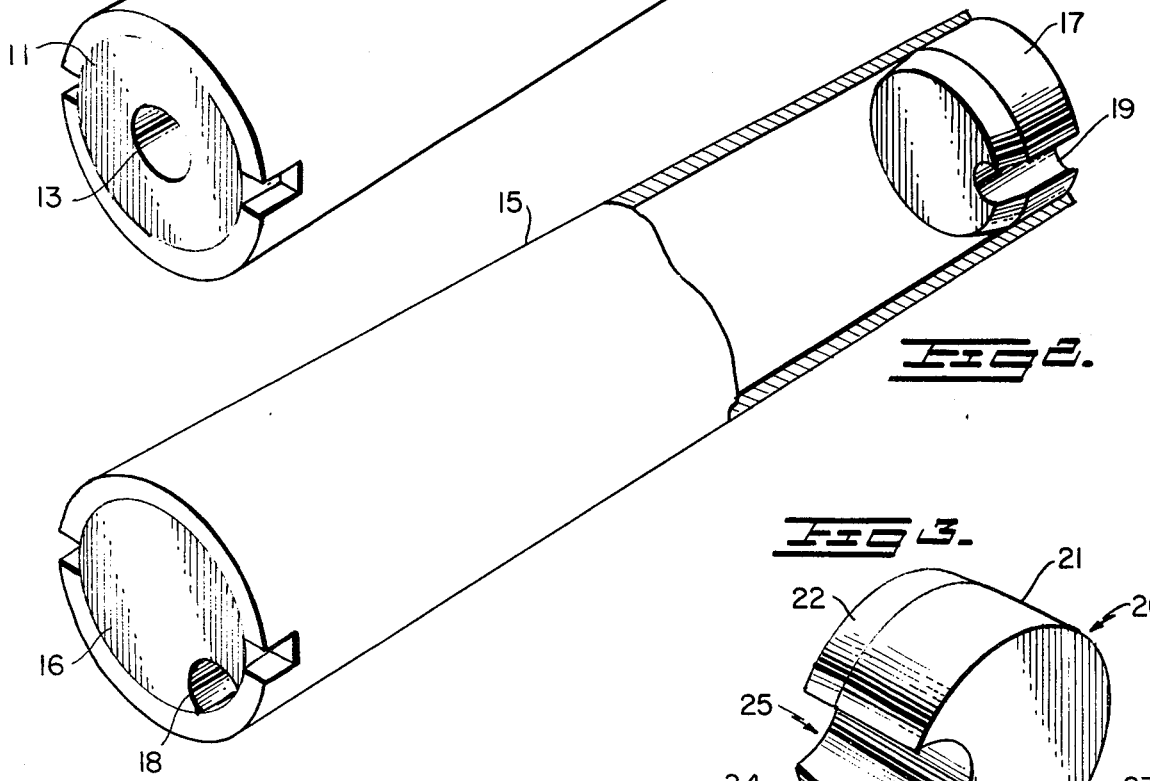
Fig 2.
Fig 3.
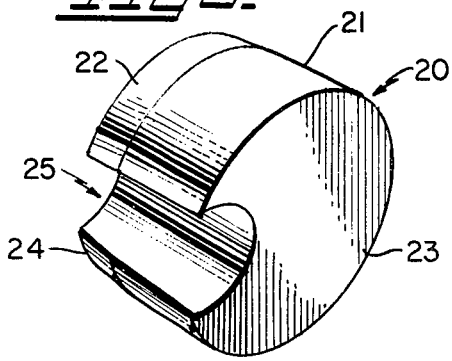
Fig 4.
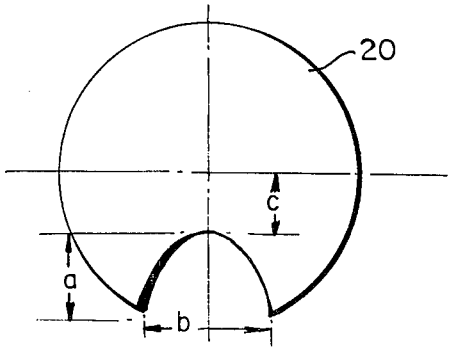
Fig 5.
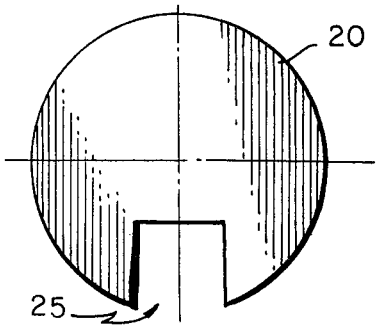

CORE PLUG

This application is a continuation of application Ser. No. 270,413, filed June 4, 1981. Abandoned Dec. 22, 1983.

BACKGROUND OF INVENTION

The present invention relates generally to an improved core plug for protecting the ends of hollow paper cores on which paper, plastic, fabric and other materials are wound for storage, shipment and use. More particularly, the present invention relates to a core plug formed from wood, plastic, or a composite woody material, that has increased strength over existing core plugs as a result of the development of a novel means for removing the core plugs from cores after use.

In paper mills, textile mills and the like, rolls of paper and/or fabric are generally wound on tubular cores which are usually made of a paper material such as cardboard or paperboard. These cores are relatively strong except that they are vulnerable at their ends where they can be easily damaged. During shipment and handling, the rolls of paper and other materials are repeatedly picked up and moved, and if the core ends become deformed in any way, the entire roll of paper or other material becomes unusable because it cannot be properly chucked. Thus, in order to protect such cores, core plugs are commonly inserted into the ends of the core.

Core plugs are presently available in a number of sizes to accomodate different sized cores. Such core plugs are formed from a variety of different types of materials, and include various distinctive features to increase their strength and utility. However, in general, the majority of such core plugs are formed from wood or molded wood material. Molded wood core plugs are available from Moldwood Corporation, Drawer 430, York, Ala. 36925. Core plugs supplied by Moldwood Corporation and as described in their sales literature are conventional in design with a centrally located hole for removing the core plugs from cores. Most core plugs must be removed before the rolls of paper, fabric or the like can be used. The core plugs may be removed by inserting a metal bar or rod into the hole provided in the plug where the plugs are wedged or pulled out. However, in general the metal bar or rod is inserted in the hole in one core plug and butted against the inside of the opposite core plug so that it can be driven out. Since core plugs may differ in size, the holes provided therein may also be of different size. Generally the bars or rods that are used to remove the core plugs are metal stock of from about $\frac{1}{2}$ to $\frac{3}{4}$ inch in diameter. Thus the holes in the core plugs must be at least as large as the bars or rods used to remove them.

Other core plug designs are disclosed in U.S. Pat. No. 4,015,711; U.S. Pat. No. 3,627,220; U.S. Pat. No. 3,547,367; U.S. Pat. No. 2,196,378; and, U.S. Pat. No. 1,919,769. The core plugs described in the aforementioned patents are in the form of shells made from plastic materials or metal, and with the exception of the core plug disclosed in U.S. Pat. No. 2,196,378, all include a centrally located hole for removing the core plugs from a core. In U.S. Pat. No. 2,196,378, the core plug includes a pair of intersecting ribs which divide the face of the core plug into four quadrants. Thus, in order not to inhibit the increased strength provided by the intersecting ribs, the hole for removing the core plug is located off center in one of the quadrants.

Notwithstanding the features and advantages described for the core plugs presently in use, the core plug of the present invention offers increased strength and durability over existing core plugs.

SUMMARY OF INVENTION

The present invention relates to an improved core plug made from wood, plastic, or a composite woody material. The core plug of the invention comprises a solid body portion with an integral tapered forward portion of substantially cylindrical shape. The outer face of the body portion has a diameter that is substantially equal to the inside diameter of the core for which the core plug is intended. Meanwhile, the inner face of the forward portion of the core plug is of slightly less diameter than the outer face to facilitate entry of the core plug into the end of a core. In this form, the core plug of the present invention has considerable strength since it does not contain the usual center hole which is used to remove a conventional core plug from a core when it is desired to chuck the core for mounting on an unwinder, rewinder or the like. In contrast to the prior art, the core plug disclosed herein is provided with an opening or groove spaced from the center of the plug and near its remote outer surface which extends the full length thereof. This arrangement permits the core plugs of the present invention to be readily and easily removed from cores in the normal fashion using a standard core plug remover as described hereinbefore. However, because the core plugs of the present invention do not contain the usual center hole, they are much stronger than conventional prior art core plugs made from the same material.

Accordingly it is an object of the present invention to provide an improved core plug for protecting the ends of hollow paperboard cores, with plain or reinforced ends, on which paper, plastic, fabric and other materials are wound for storage, shipment and use.

Another object of the present invention is to provide a core plug of increased strength that is a result of the omission of the usual center hole required for removing the core plug from a core.

The core plug of the present invention is preferably made of wood, plastic or a composite woody material in a mold, or machined from stock where desired. An example of a composite woody material is molded wood which may be defined as a composition of wood shavings, chips or sawdust, resins and/or glue which is mixed together and heated under pressure in a mold to produce the desired shape. The significant point is that the core plugs of the present invention are substantially solid bodies which include a core plug removing opening or groove spaced from the center.

Other and further objects of the invention will become more apparent from a consideration of the following detailed description taken with the accompanying drawing.

DESCRIPTION OF DRAWING

FIG. 1 is a perspective view of a typical core having conventional prior art core plugs located in each end;

FIG. 2 is a perspective view with one end in section showing a tubular paper core with both ends reinforced with core plugs made according to the present invention;

FIG. 3 is an enlarged perspective view of a core plug made according to the present invention;

FIG. 4 is an end view of a core plug according to the present invention showing a typical shape for the core plug opening or groove; and, FIG. 5 is a view similar to FIG. 4 showing a modified shape for the opening or groove.

DETAILED DESCRIPTION

As shown in FIG. 1, an elongated paper core 10 is illustrated with a pair of conventional end core plugs 11,12 inserted in each end. The conventional core plugs each include centrally located holes 13,14 through which a core plug removing bar can be inserted for removing the core plugs. These core plugs 11,12 serve to protect the ends of the core 10 during storage and shipment by absorbing impact shocks during handling and crushing loads during shipment. Meanwhile, FIG. 2 illustrates the novel core plug design according to the present invention.

In FIG. 2, a typical paperboard core 15 is illustrated with core plugs 16,17 inserted in each end. These core plugs 16,17 are preferably made from wood or a molded woody material but may be fabricated from other materials such as plastic where cost is no object. Each core plug 16,17 is provided with a core plug removing opening or groove 18,19 located near the outer surface thereof which gives the core plugs 16,17 greater crush strength than the conventional core plugs 11,12 shown in FIG. 1. The increased strength has been demonstrated by the results of crush tests conducted on sample core plugs.

A series of core crushing experiments were conducted on wooden pine core plugs and molded wood core plugs to measure their resistance to crushing. The tests were conducted according to standard testing procedures established by the Composite Can and Tube Institute (CCTI). Each of the core plugs had a nominal outside diameter of about three inches.

In each case a core containing a core plug is placed in a compression testing machine having upper and lower platens which are held rigidly parallel during testing permitting movement in a vertical direction only. The speed of the moving platen is set at ½ inch per minute. The core containing core plug is placed at the center between the two platens, and a crushing load is applied until the load becomes constant, or drops, indicating core plug failure, or the equipment reaches its load limit. The data is recorded on a strip chart and the applied load readings are taken from the curve in 0.1 inch increments.

EXAMPLE I

In this example a series of core crushing tests were conducted with wooden pine core plugs. The results obtained from four separate tests using conventional core plugs and core plugs made according to the present invention were averaged to produce the data shown in Table I. The data shows that for wooden pine plugs, grain direction plays a major role in overall crush resistance. In the tests where the grain direction is aligned with the direction of applied force, crush strengths are generally higher than those obtained with the grain direction oriented perpendicular to the applied force. Where the grain direction is perpendicular to the direction of applied force, crush strength is influenced primarily by compression of the wood grain.

TABLE I

| Increments (inches) | Load Applied: Center Hole (lbs.) | Side Opening (lbs.) | Top Opening (lbs.) |
|---|---|---|---|
| Grain Direction Parallel To Force Applied | | | |
| .1 | 880 | 870 | 890 |
| .2 | 1270 | 1270 | 1100 |
| .3 | 1770 | 1800 | 1370 |
| .5 | 3200 | 3740 | 2530 |
| | Failed @ 0.51 (3540) | | |
| .7 | | 8310 | 4960 |
| | | | Failed @ 0.80 (6620) |
| .9 | | 10000* | |
| Grain Direction Perpendicular To Force Applied | | | |
| .1 | 810 | 910 | 800 |
| .2 | 1110 | 1180 | 970 |
| .3 | 1500 | 1530 | 1120 |
| .5 | 2440 | 2390 | 1820 |
| .7 | 3230 | 3050 | 2770 |
| | Failed @ 0.84 (3610) | | |
| .9 | | | 3830 |
| | | Failed @ 1.02 (3830) | |

*Load Limit of Compression Testing Machine

In the data shown in Table I, the reference "center hole" is to a conventional wooden pine plug with a core plug removing hole in the center. The references "side opening" and "top opening" are to core plugs made according to the present invention with the core plug turned so that the removal opening is located either at the side or top of the core plug. The data shows that the conventional core plug failed in each case before reaching the 0.9 inch increment of compression and a load of about 3600 pounds. With the grain aligned with the applied force, the center hole core plug failed at 3610 pounds compression. Meanwhile, the core plugs according to the present invention resisted failure until at least a greater force was applied. With the grain parallel to the applied force, and the core plug turned so the opening was on one side, there was no failure with the maximum of 10,000 pounds of load applied. With the same grain direction and the opening at the top (or bottom) the core plug failed at 6620 pounds. With the grain perpendicular to the applied force, and the opening at one side, the core plug failed at 3830 pounds. Meanwhile, with the opening at the top (or bottom), the core plug withstood the same load without failure.

EXAMPLE II

In this example a series of core crushing tests were conducted with molded wood plugs. The results obtained from several separate tests using both styles of core plugs were averaged to produce the data shown in Table II. Only one set of data points were gathered since molded core plugs do not have the same grain effects encountered with solid wooden plugs.

TABLE II

| Increments (inches) | Load Applied: Center Hole (lbs.) | Side Opening (lbs.) | Top Opening (lbs.) |
|---|---|---|---|
| .1 | 980 | 1160 | 1030 |
| .2 | 1700 | 1700 | 1370 |
| .3 | 2460 | 2430 | 1780 |
| .5 | 4910 | 5230 | 3360 |
| | Failed @ 0.50 (4980) | | |
| .7 | | 10,000* | 6160 |

TABLE II-continued

| Increments (inches) | Load Applied Center Hole (lbs.) | Side Opening (lbs.) | Top Opening (lbs.) |
|---|---|---|---|
| .9 | | | 10,000* |

*Load Limit of Compression Testing Machine

In the data shown in Table II, the references to "center hole", "side opening" and "top opening" are the same as described for Example I. In this test with molded plugs, the conventional center hole core plug failed at an average load of 4980 pounds. With the core plug manufactured according to the present invention, and the opening located at one side, there was no failure at 10,000 pounds and a deflection of 0.70 inch. When the core plug was turned to orient the opening at the top (or bottom), there was no failure at 10,000 pounds with a deflection of 0.89 inch. Accordingly, it may be seen that both solid wooden core plugs and molded core plugs made according to the present invention are stronger in crush strength than conventional center hole core plugs made from the same materials.

An example of the core plug of the present invention is shown enlarged in FIG. 3. The core plug 20 has a solid cylindrical body portion 21 that fits tightly into the end of a core and an integral tapered forward portion 22 for facilitating entry of the core plug into the core. The outer face 23 of the core plug and the cylindrical body portion 21 are formed with a diameter that is substantially equal to the inside diameter of the core for which the core plug is intended. The inner face 24 of the core plug and the tapered forward portion 22 is of slightly less diameter than the outer face 23. The core plug 20 includes a core plug removal opening or groove 25 spaced from the center thereof at the outer peripheral surface which extends the full length of the core plug. In the case of solid wooden core plugs, the opening or groove may be applied to the core plug by milling, routing or drilling. Where the core plugs are molded, the opening or groove may be molded in place.

As shown in FIGS. 4 and 5, the shape of the opening or groove 25 is not particularly significant. However, in order to accomodate a core plug removing rod or bar, the geometry of the opening or groove must meet certain minimum dimensions. For instance, the opening should have a minimum area of about 0.2 square inch, and a maximum area no greater than about 20% of the total area of the outer face of the core plug. Other exemplary dimensions for the opening 25 in a core plug of nominally three inches diameter are a depth "a" as measured from an edge of the core plug equal to or less than about one inch; a width "b" as measured along the outer edge of the core plug equal to or less than about one inch; or a distance "c" from the center line of the outer end 23 of the core plug to the bottom of opening 25 less than about one-third the diameter of the outer end 23. It should be understood in this regard that for the paper industry, core plugs are used which vary in size from about two inches up to fourteen inches in diameter. Conventional center holes in these plugs vary in size from about one inch up to four inches in diameter. However, in order to increase the strength of a core plug the opening in the core plug to facilitate its removal should be as small as possible. In such a case, the opening should be at least large enough to accomodate the rod or bar normally used to remove core plugs from cores.

It will thus be seen that the core plug of the present invention is distinct from prior art core plugs and because of this distinctiveness achieves a strength greater than conventional core plugs. Accordingly, while the detailed disclosure set forth above fully describes the new core plug in at least one embodiment, it is obvious that modifications and variations may be made to the core plug by those skilled in the art within the limitations of the claims appended hereto.

We claim:

1. An improved core end plug for reinforcing and preventing damage to the ends of hollow, tubular cores on which webs of paper, plastic, fabric and other material is wound, said core plug comprising a solid, elongated cylindrical body formed from wood, plastic or a composite woody material having sufficient strength to absorb impact shocks and crushing loads experienced by the core ends during handling and shipping, said core plug having an outer face of slightly greater diameter than the inner face that is inserted into the ends of the cores after the material is wound thereon and before shipment, said core plug including a means for removing it from the cores after shipment, said means comprising a core plug removal opening in the form of an elongated groove completely located in the outer peripheral surface of the core plug and extending throughout the full length of the core plug for providing increased strength to absorb impact shocks and crushing loads experience during handling and shipping, said groove occupying an area at the outer face of the core plug of at least about 0.2 square inch and no greater than about 20% of the total area of the outer face of the core plug so as to accomodate a core plug removal tool thus permitting the core plug to be removed from the cores after shipment.

2. The core plug of claim 1 wherein the groove has substantially curved sides and a curved bottom.

3. The core plug of claim 1 wherein the groove has substantially straight sides and a substantially flat bottom.

4. In combination, a hollow tubular core on which webs of paper, plastic, fabric and other material may be wound and a core end plug formed from wood, plastic or a composite woody material that is inserted into the ends of the core prior to shipment for reinforcing and protecting the ends of the core from damage during handling and shipping, said core plug comprising a solid, elongated cylindrical body having an outer face of slightly greater diameter than its inner face and including a core plug removal opening in the form of an elongated groove located completely in the outer peripheral surface of the plug which extends throughout the full length of the core plug for providing increased strengths to absorb impact shocks and crushing loads during handling and shipping, said groove occupying an area at the outer face of the core plug of at least about 0.2 square inch and no greater than about 20% of the total area of the outer face of the plug to accommodate a removal tool for removing the plug from the core after shipment.

* * * * *